US005257489A

United States Patent [19]

Angelette

[11] Patent Number: 5,257,489

[45] Date of Patent: Nov. 2, 1993

[54] RAILROAD CROSSING SIGNAL FOUNDATION

[76] Inventor: A. M. Angelette, 4160 Ewing Rd., Austell, Ga. 30001

[21] Appl. No.: 776,564

[22] Filed: Oct. 15, 1991

[51] Int. Cl.[5] ..... E02D 27/42; E04G 21/14

[52] U.S. Cl. ..... 52/295; 52/301; 52/742; 405/252

[58] Field of Search ..... 52/295, 169.9, 296, 52/297, 298, 742, 301, 300, 125.1, 125.2, 125.3, 125.4, 125.5, 125.6; 248/679; 405/220, 250, 251, 252

[56] References Cited

U.S. PATENT DOCUMENTS

| | | | |
|---|---|---|---|
| 178,438 | 6/1876 | Hill | 405/251 |
| 1,447,942 | 3/1923 | Fitzgerald . | |
| 1,529,895 | 3/1925 | Chance et al. | 52/296 |
| 2,282,251 | 5/1942 | Schwendt | 52/296 |
| 2,367,146 | 1/1945 | Siebs . | |
| 2,373,798 | 4/1945 | Williams | 52/296 |
| 2,374,624 | 4/1945 | Schwendt | 52/301 |
| 2,381,014 | 8/1945 | Thornley . | |
| 2,917,901 | 12/1959 | Lackner . | |
| 4,592,678 | 6/1986 | McNinch, Jr. et al. . | |
| 4,704,052 | 11/1987 | Aubert . | |

FOREIGN PATENT DOCUMENTS

| | | | |
|---|---|---|---|
| 8004538 | 3/1982 | Netherlands | 52/295 |

*Primary Examiner*—Michael Safavi
*Attorney, Agent, or Firm*—Kennedy & Kennedy

[57] ABSTRACT

A railroad crossing signal foundation 10 comprises a base 11 having a lower concrete slab 15' to which a set of upright guide rods 18 is mounted and upper concrete slabs 15 supported upon the lower slab through which the guide rods extend. A pillar 12 is mounted upon the base that has concrete blocks 16 through which the guide rods extend. The pillar blocks have a support area size substantially less than the support area size of the base slabs such that the pillar may be erected with workers standing upon the base. A concrete crown 13 is mounted upon the pillar through which the guide rods extend. The weight of the foundation components is such that the center of gravity of the foundation is located in the base.

8 Claims, 8 Drawing Sheets

RAILROAD CROSSING SIGNAL FOUNDATION

TECHNICAL FIELD

This invention relates generally to foundations for railroad crossing signal and traffic control devises, and particular to railroad crossing signal and traffic control foundations made of precast concrete components.

BACKGROUND OF THE INVENTION

Today there exists a vast number of railroad crossings where automotive roads and highways cross railroad tracks. In early times signs were erected at such crossings to warn automotive vehicle drivers of the railroad crossing and thereby avoid the possibility of a collision with a train. Later such signs were made larger and equipped with flashing lights. Major crossings were equipped with barrier bars that were automatically raised and lowered in response to the sensed presence of a train. As roads and highways were enlarged into more than two lanes, these barriers became larger and heavier. This in turn meant that they had to be supported on stronger and stronger foundations in the ground aside the railroad crossings.

These foundations have heretofore been constructed in a number of manners. Some foundations have been formed by merely digging a hole in the ground and filling the hole with concrete to which upright signal masks were anchored. This has been costly in that it is required that mixed concrete in fluid form be transported to each site. Other foundations have been in the form of a welded, pyramidal arrays of angle irons. They however have been costly to the manufacture, transport and embed.

In more recent years railroad crossing signal and traffic control foundations have been made of precast, steel reinforced, concrete components erected one atop the other in a ground hole. This has typically been done by digging an 8½ to 9 foot deep, generally 11 foot square hole in the ground adjacent a railroad crossing. A safety wall is then erected inside the hole to protect laborers working in the hole in case of ground wall collapse and avalanche. With workers located both within the hole and above ground, these foundations has been erected piece by piece in constructing a base upon which a relatively slender tower is built with interlocking blocks to approximately ground level. A crown, sometimes referred to as a doughnut, to which a signal mask may be mounted, is finally mounted atop the tower and the hole filled.

Foundations of the type just described have proven to be very hazardous and costly to construct. Not only is working in a 9 foot hole deep earth inherently dangerous, but the workers have to manipulate heavy concrete structures as they are lowered by cables into the holes in close proximity. Many workers have been injured and killed from time to time from earth avalanches and mishaps in offloading and manipulating the heavy concrete members. Their stability has also been lacking in high wind conditions in their less than satisfactory resistance to in-earth rotation.

Accordingly, it is seen that a railroad crossing signal and traffic control foundation has long remained needed that may be erected in a safer and more cost efficient manner. It is to the provision of such therefore that the present invention is primarily directed.

SUMMARY OF THE INVENTION

A railroad crossing signal foundation comprises a base having a lower concrete slab to which a set of upright guide rods is mounted and upper concrete slabs supported upon the lower slab through which the guide rods extend. A pillar is mounted upon the base comprised of concrete blocks through which the guide rods extend. The pillar blocks have a support area size substantially less than the support area size of the base slabs such that it may be erected with workers standing on the base. A concrete crown is mounted upon the pillar through which the guide rods extend. The weight of the base, pillar and crown is such that the center of gravity of the foundation is located in said base.

A method of constructing a railroad crossing signal foundation comprises the steps of digging a hole in the ground adjacent the crossing with a generally flat and level hole floor of a selected size. A base is erected in the hole of a size that occupies the hole sufficiently to preclude workers from entering the hole during construction of the base and standing beside it and which eliminates the need for a safety wall to be erected in the hole. A pillar is erected upon the base of a size that enables a worker to stand upon the base during erection of the pillar. A crown is mounted upon the pillar to which a railroad crossing signal may later be mounted.

BRIEF DESCRIPTION OF THE DRAWING

FIG. 16 is a perspective view of a railroad signal foundation of still another preferred embodiment of the invention while

DETAILED DESCRIPTION

Figure 1:
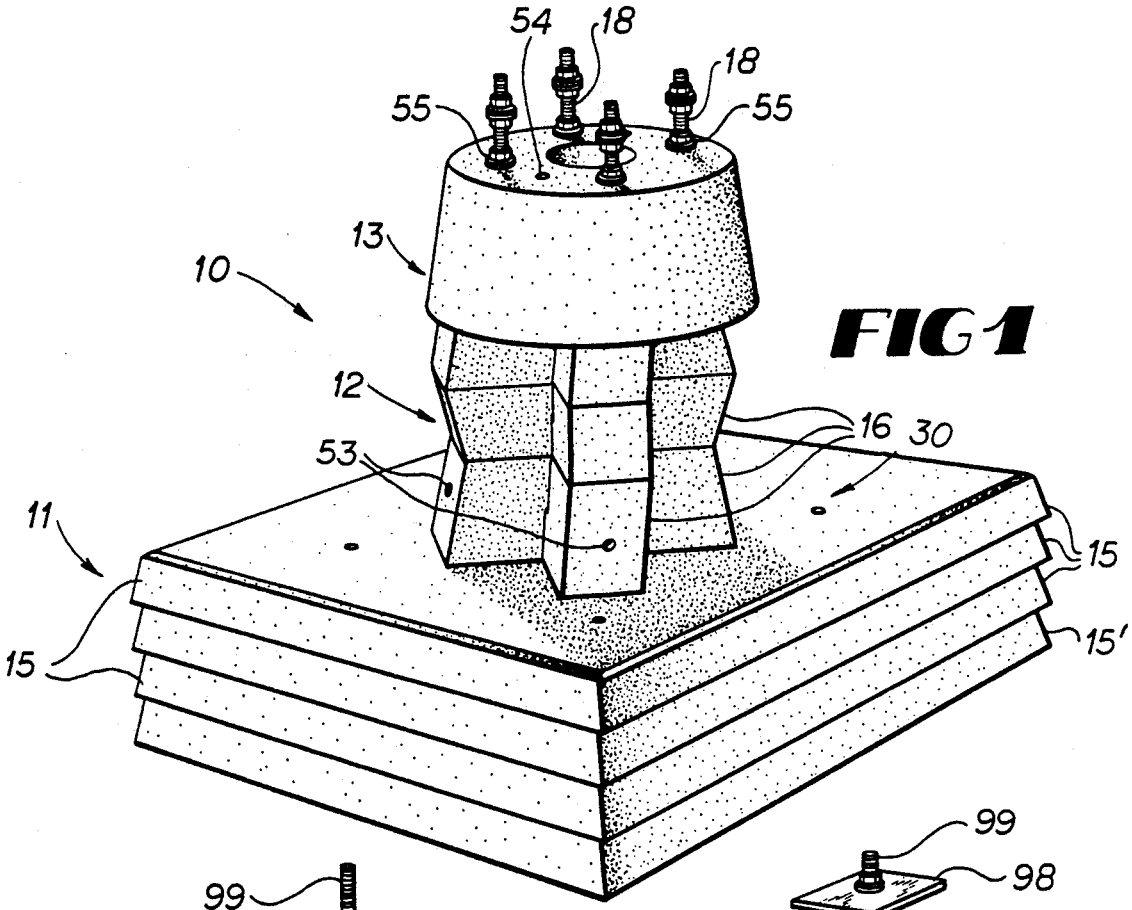
FIG. 1 is a perspective view of a railroad crossing signal and traffic control foundation embodying principles of the invention in a preferred form.

With reference next to the drawing, there is shown in FIG. 1 a railroad crossing signal and traffic foundation 10 of the present invention. The foundation here has a base 11, a pillar 12, and a crown 13, all of which are made of precast concrete structures.

The base 1 here is comprised of four single piece slabs 15 mounted one atop the other into a four tiered stack. The pillar or column 12 is comprised of three pairs of interlocked spider blocks 16 mounted one pair upon the other into a three tiered stack. A conventional crown, which is sometimes referred to as a doughnut, is mounted atop the pillar 12. The base slabs 15, spider blocks 16 and crown 13 are all retained in position by four steel guide rods 18 that extend upwardly from the bottom base slab 15'.

As shown in FIG. 2-5, the bottom base slab 15' is manufactured in a mold 20 having an interior floor surface 21 shaped to form the top of the slab and interior side wall surfaces 22 shaped to form the sides of the slab. These side wall surfaces are slightly tapered for ease in extracting the formed slabs from the mold which results in the slabs sides being slightly tapered, as shown in FIG. 1.

Figure 7:
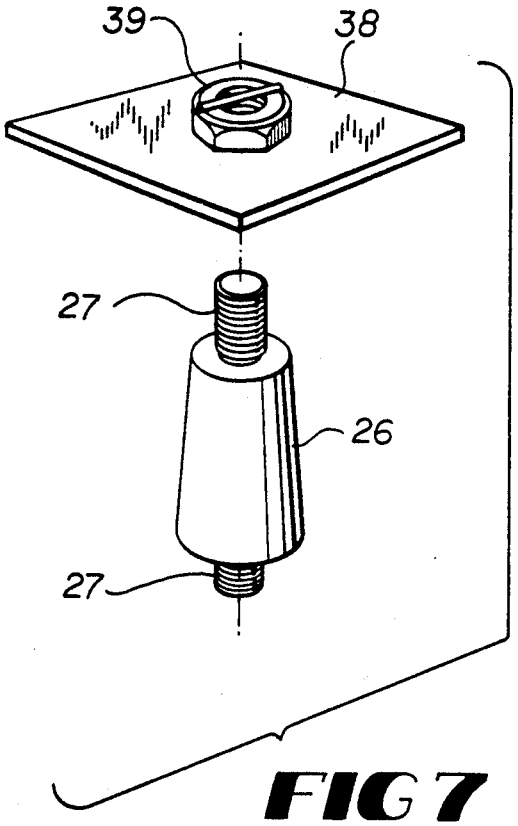
FIG. 7 is an exploded view of an assembly of mechanical parts used in the process of manufacturing the foundation of FIG. 1 with guide rod mounting nuts and nut holding plates.
Figure 8:
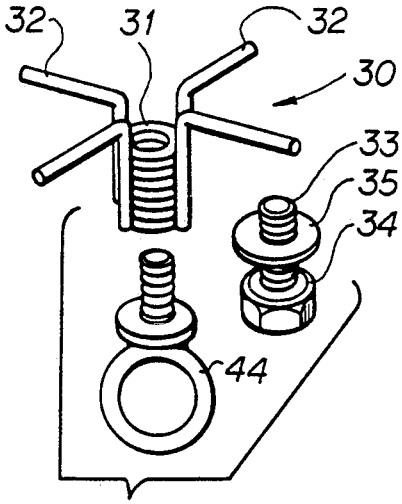
FIG. 8 is an exploded view, in perspective, of a foundation insert together with an insert mounting bolt and eyebolt used during manufacture and assembly of the foundation.
Figure 10:
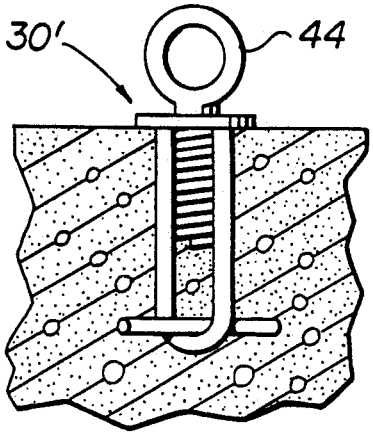
FIG. 10 is a side elevational view of an insert and eyebolt of the foundation of FIG. 1 shown embedded in concrete.
Figure 11:
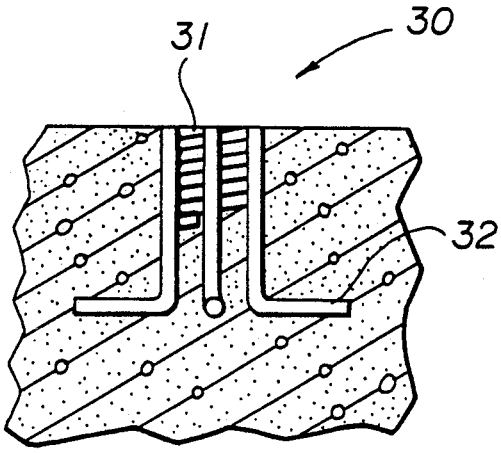
FIG. 11 is a side elevational view of an insert incorporated into the foundation of FIG. 1.

The floor surface 21 has a set of four inner holes 23 and a set of four outer holes 24. Four conically shaped forming plugs 26, as best seen in FIG. 7, have a threaded post 27 extending coaxially from opposite ends which are mounted in the mold by threading the posts 27 into the holes 23 with the larger ends of the plugs 26 resting on the mold floor 21. Four lifting insert 30, best shown in FIG. 8, are mounted to the mold floor 21 over the outer holes 24. Each insert has a coil 31 to which four L-shaped arms 32 are mounted. They are temporarily mounted in place with bolts 33 that are threaded into the holes 24 with bolt heads 34 and washers 35 located outside and beneath the mold. The insert coils 31 are then threaded onto bolts 33. An insert 30 is illustrated in FIG. 11 embedded in concrete while an insert 30' of alternative construction is shown embedded in concrete in FIG. 10.

Figure 3:
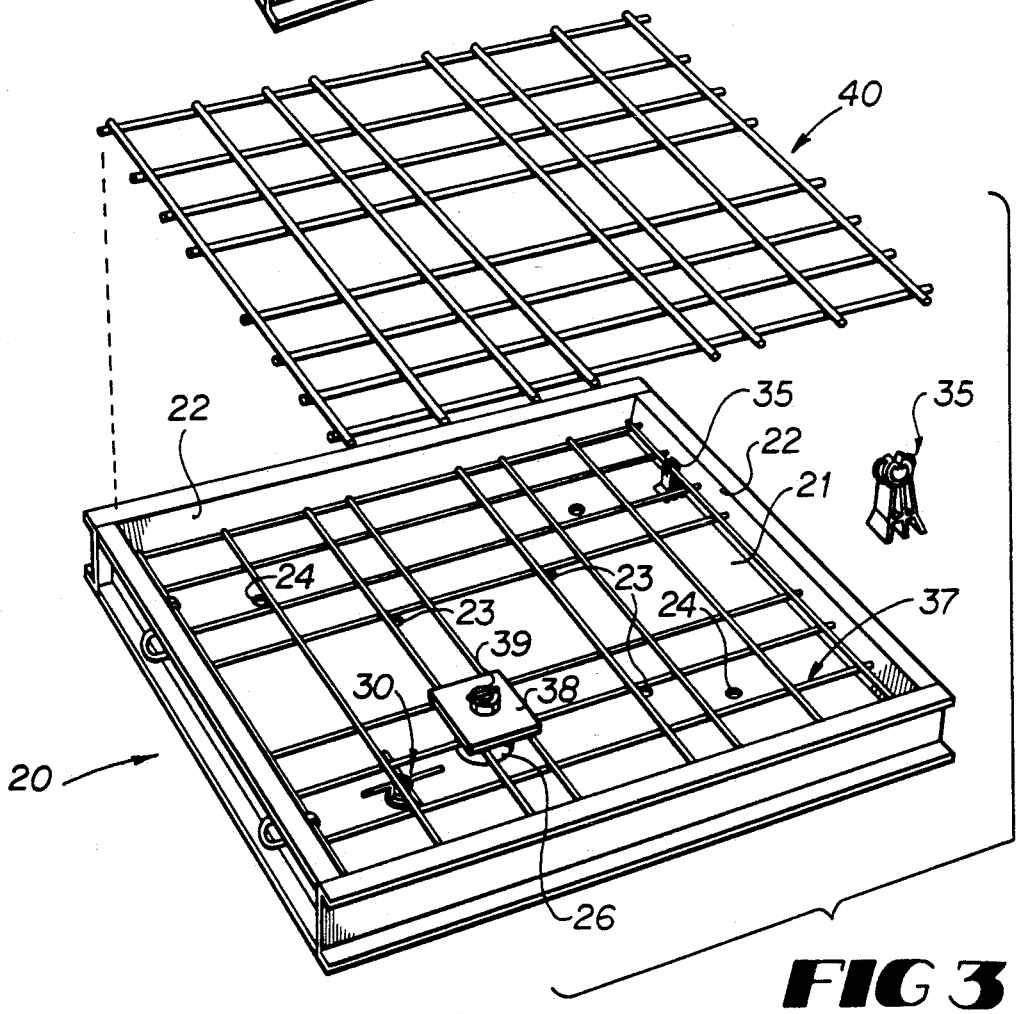
FIG. 3 is a partially exploded view, in perspective, of the mold of FIG. 2 with reinforcing rods.
Figure 4:
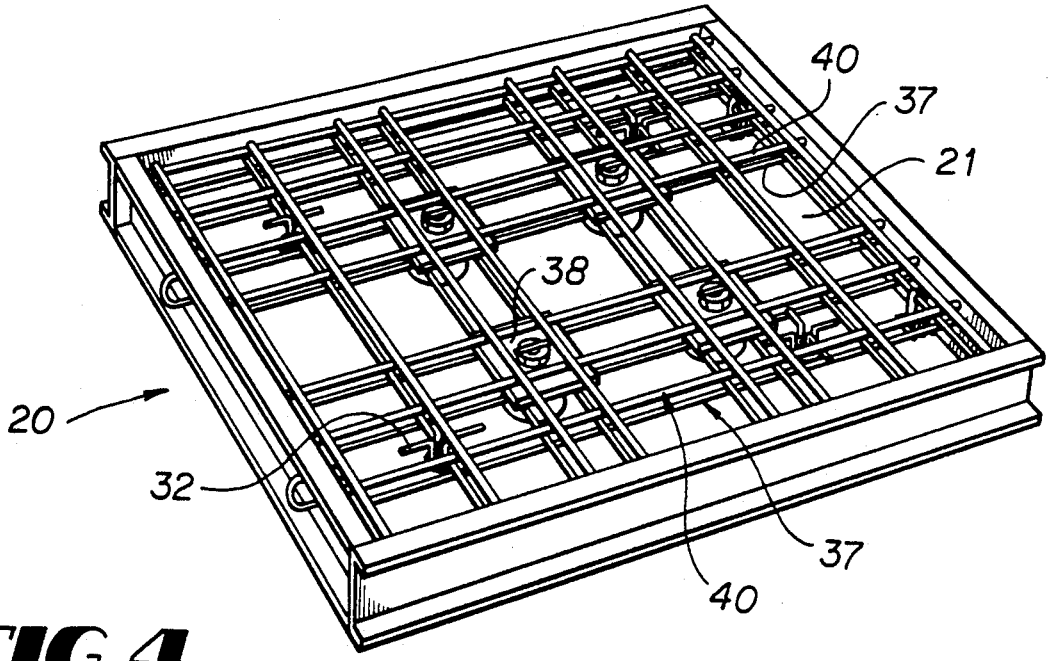
FIG. 4 is a perspective view of the mold of FIG. 2 with all of the rods mounted therein.
Figure 5:
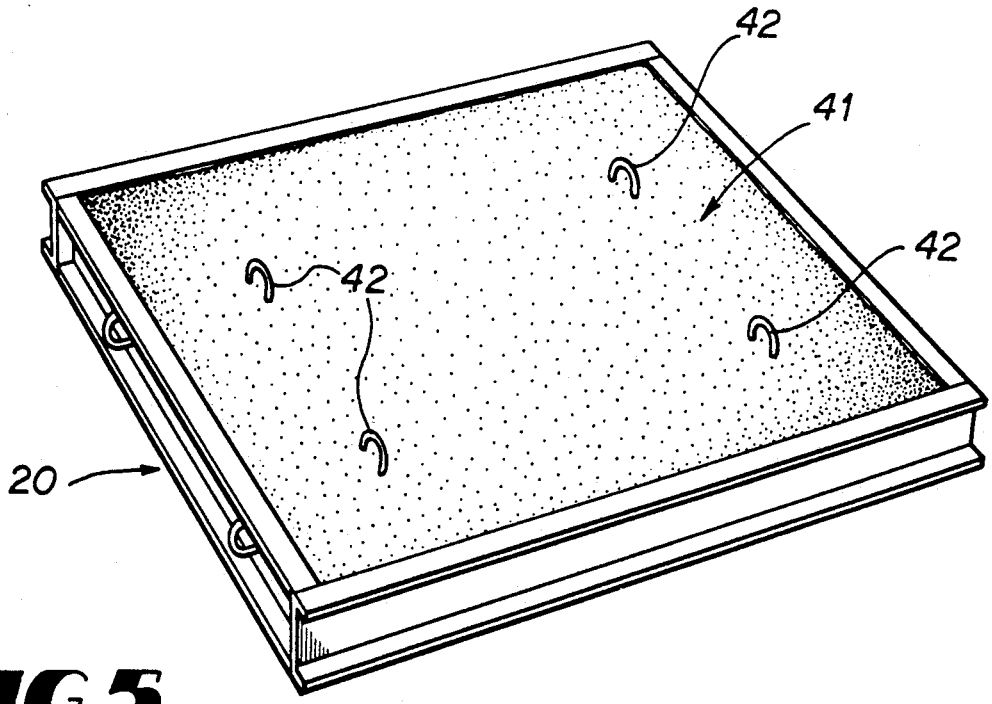
FIG. 5 is a perspective view of the mold and rod mesh assembly of FIG. 4 filled with concrete.

Next, a set of plastic spacers 35, which are referred to as chairs in the industry, is placed uprightly onto the mold floor 21. A flat, lower grid 37 of welded steel reinforcing rods is placed atop the spacers 35, offset from the inserts coils 31. Anchor plates, 38 having central holes therethrough to which nuts 39 are welded as shown in FIG. 7, are mounted atop the forming plugs 26 by threading the nuts 39 onto the posts 27. Then the lower portions of posts 27 are threaded into holes 23. As shown in FIG. 3, once mounted the anchor plates overlay some of the rods of the lower grid 37. An upper grid 40 of steel reinforcing rods is then mounted upon the plates 38 as shown in FIG. 4 with some of its rods also overlaying the plates 38. Concrete 41 is now poured into the mold until it is substantially filled. The upper surface of the concrete is smoothed and four U-shaped lifting wires 42 inserted with their bights left exposed, as shown in FIG. 5. The concrete is then allowed to set. Once hardened the mold is inverted and the slab lifted from the mold, and the lifting wires 42 severed. Finally, the forming cones 26 are removed by unthreading the posts 27 from the nuts 39 and lifting eyes 44 substituted for bolts 34.

Once made, the base bottom slab 15' is of an extremely strong and rigid construction. It has four pulling eyes extending from its top surface so that it may be lifted and lowered with chains. It also has four tapered holes that extend down to the four anchor plates 38 to which guide rods may be mounted by threading threaded ends of the rods into the nuts 39. With the anchor plates 38 sandwiched between rods members of both the lower and upper grids, whose relative positions are now reversed, extremely strong anchors are provided. The four guide rods 18, of which only their top ends are shown in FIG. 1, are then mounted to the base slab 15'. At this point their appearance is similar to the assembly shown in FIG. 13, although this version has more guide rods.

Figure 6:
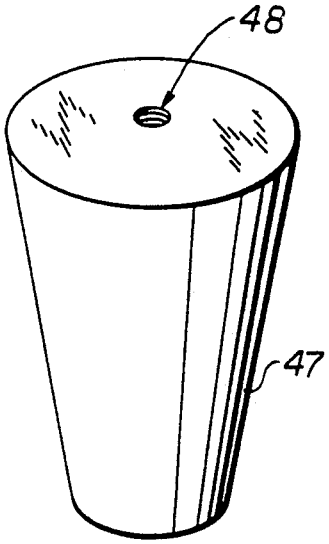
FIG. 6 is a forming plug used in manufacturing the spider blocks of the foundation of FIG. 1.

The three slabs 15 that rests upon the bottom slab 15' are produced in a similar manner. For these however a larger, tapered, conical forming plug 47, shown in FIG. 6, is used lieu of the plugs 26. They are set upon the floor 21 of the mold so that larger, tapered holds are formed that extend completely through these slabs. They have axially threaded holes for use in removing them from the concrete after it has set. The larger ends of the resultant holes are located on the bottom surfaces of the slabs to facilitate guiding them over the guide rods 18 as they are lowered in sequence onto the bottom slab 15' and each other.

A pillar 12 is mounted also on the four guide rods 18 atop the top slab member of the base 11. The pillar is comprised of three tiers of interlocked spider blocks 16 that have unshown transverse, open top channels. Each tier has two conventional steel reinforced concrete spider blocks mounted transversely to each other in log-cabin fashion with each block oriented diagonally across the square shaped base slabs. Each spider block has two tapered holes therethrough that receive the guide rods 18. This diagonal orientation enables the pillar also to be mounted to bases composed of two-piece slabs through each of which a pair of the guide rods extends.

Figure 9:
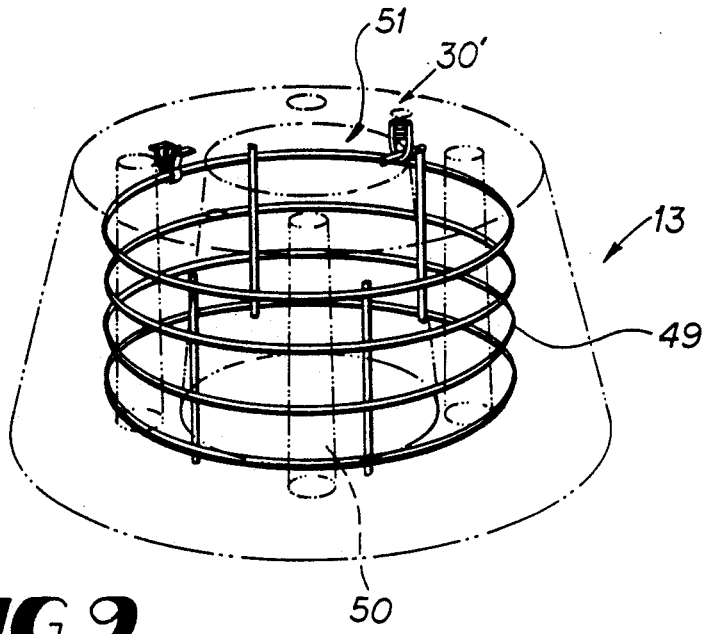
FIG. 9 is a perspective view of the framework of the crown or doughnut of the foundation.

Finally, the crown 13 is mounted atop the pillar 12. As shown in FIG. 9 the concrete crown, which is of frusto-conical shape, is ruggedized with an annular array of reinforcing steel rods 49. Four tapered holes 50 extend through the crown about a large central hole 51.

Figure 13:
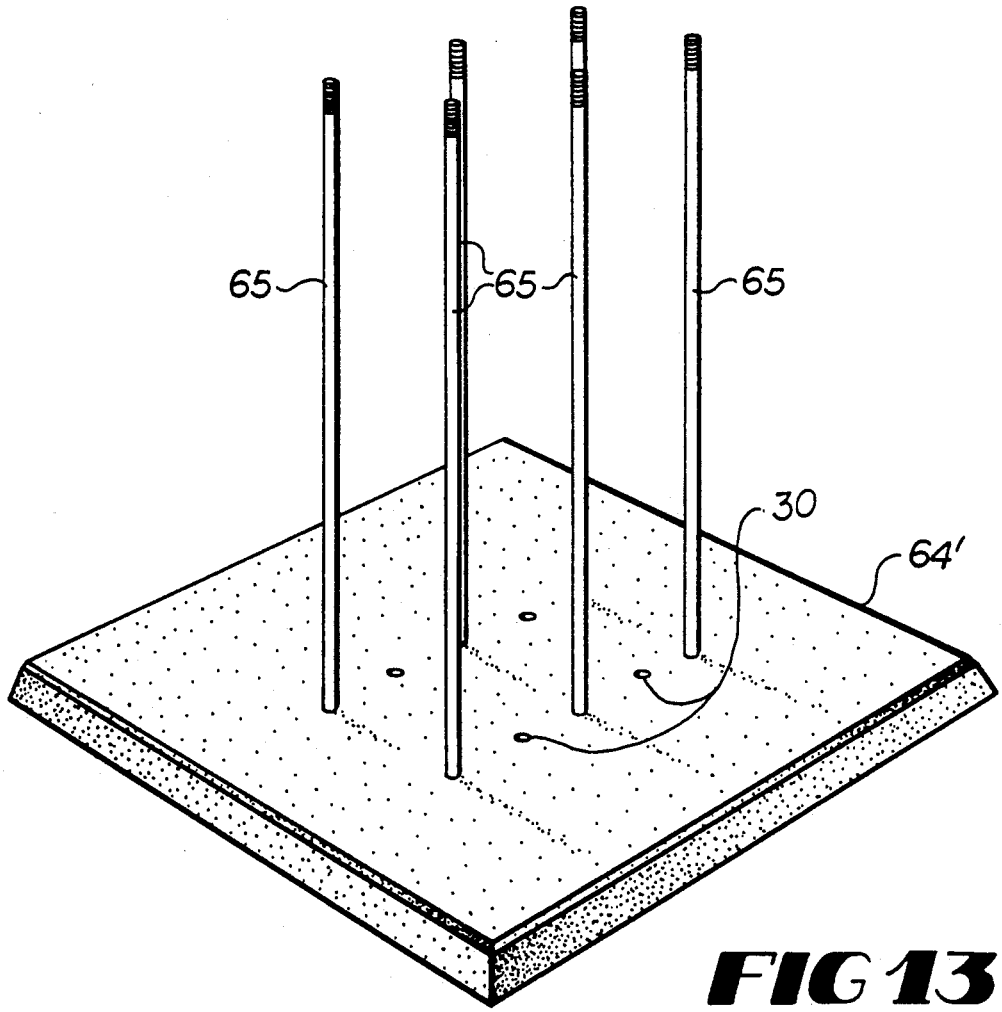
FIG. 13 is a perspective view of the bottom base slab member of the foundation of FIG. 12.

To construct the foundation of FIG. 1, a 5 foot deep, 7 by 7 foot square hole is dug in the ground. The floor of the hole is raked level by workers standing or kneeling on the ground above the hole with long handle rakes. With the eyebolts 44 shown in FIG. 8 mounted in the inserts 30, the bottom slab 15' is lowered by chains looped through the eyebolts onto the hole floor. As the slab is 6½ foot by 6½ foot, there is too small a space beside the slab and earth wall of the hole for a worker to be. This serves to prevent one from even entering the ground hole against the standing instructions of his supervisor or foreman once assembly has begun. With the bottom slab properly in place, the eyebolts are unthreaded by rotating the chains. The bottom slab now appears generally as shown in FIG. 13, with the exception that that slab has six guide rods. The second, third and fourth tiers of slabs 15 are then lowered in sequence into place by sliding them over the guide rods 18. After each slab is lowered its eyebolts are removed. In this manner the base is constructed in the ground without a worker entering the hole.

With the base now formed, the pillar 12 is erected upon it. In doing this workers may enter the hole and stand atop the base. There is little danger in their now doing this since they are only about waist deep. Any wall collapse thus does not pose much of a hazard. Also, should a spider block be mishandled and fall, there is ample space for the worker to avoid it. The spider blocks 16 may be lowered one by one into place upon the base and upon each other by passing them down along the guide rods 18 with the pair of each tier fitted together in log cabin-like fashion. This is done with chains attached to eyebolts mounted in spider side holes 53 shown in FIG. 1. Alternatively, all three tiers may be lowered simultaneously as a set. Finally, the crown 13 is lowered into place by chains looped through eyebolts temporarily mounted in crown holes 54. Nuts 55 are mounted on the guide rods flushly atop the crown.

Figure 12:
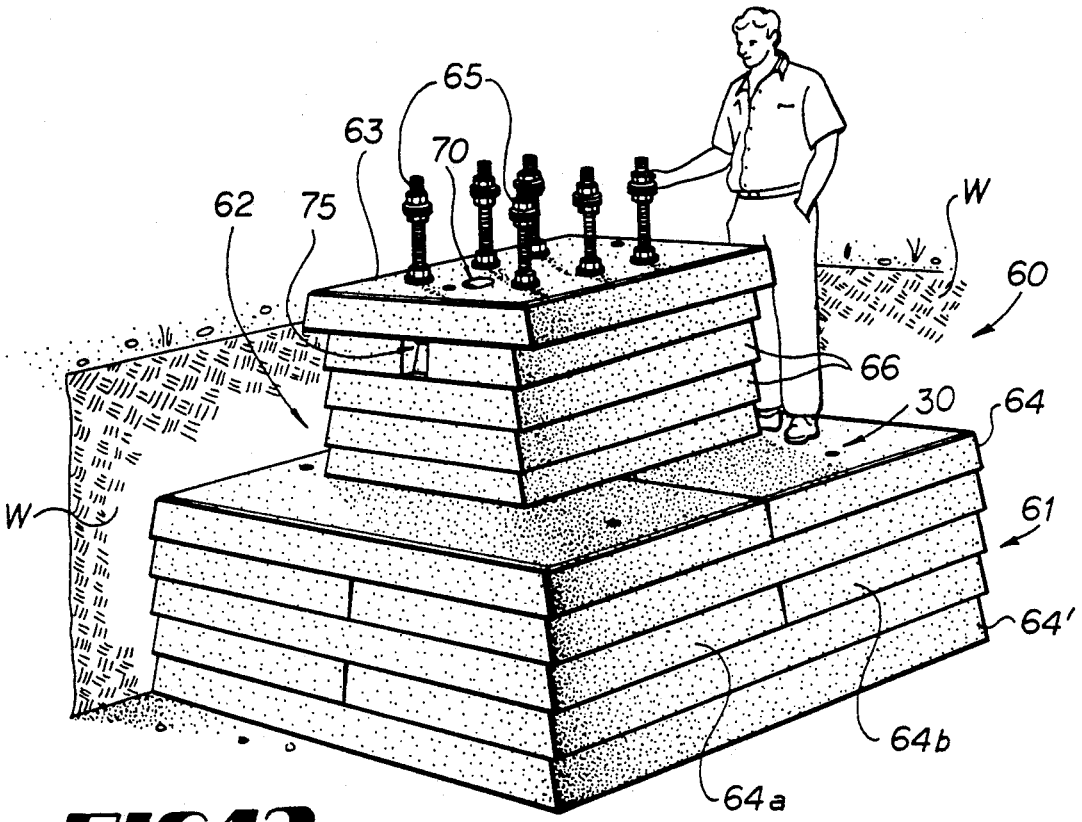
FIG. 12 is a perspective view of a railroad signal foundation in an alternative form of the invention.

With reference next to FIGS. 12 and 13, a foundation 60 of alternative construction is shown having a base 61, a pillar 62 and a crown 63. The base is comprised of five tiers of slabs 64 that includes a bottom member 64'. As best shown in FIG. 13, the bottom slab 64' anchors six steel guide rods 65 and has four eyebolt inserts 30. The slab 64' is constructed in the same manner as previously described. The tiers of slabs 64 above the bottom member 64' here is seen to be of two pieces **64*a* and 64*b* instead of single, unitary, concrete construction as that of FIG. 1**, with the orientation of each adjacent tier being offset 90°. The base is assembled closely adjacent the walls W of the earth hole, as also previously described.

Figure 15:
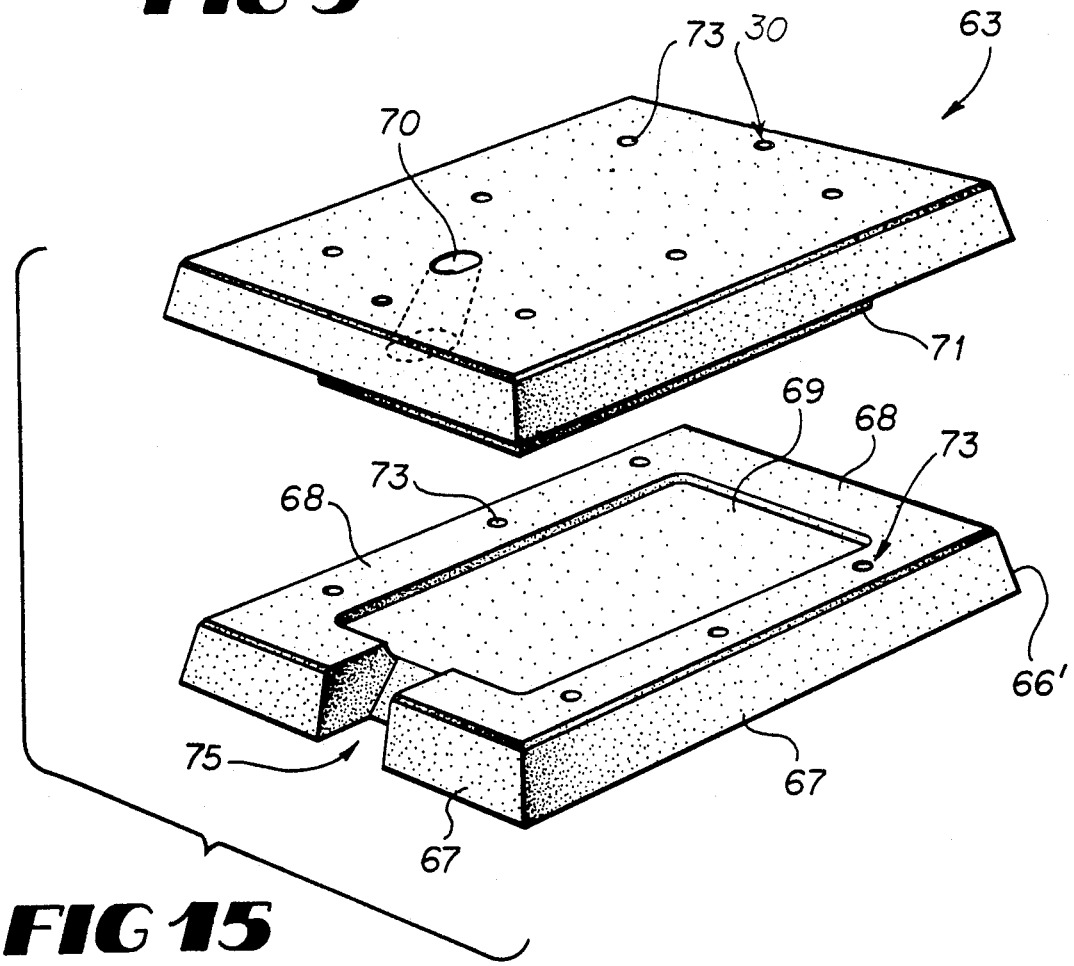
FIG. 15 is an exploded view, in perspective, of a top two spider members of the foundations of FIGS. 12 and 14.

The pillar 62 here is comprised of four nestable blocks 66, the top one 66' of which is shown in FIG. 15. The pillar blocks here are rectangular with their sides 67 being slightly sloped. Their top surfaces have a flat, peripheral region 68 that bounds a central depression 69. Except for the bottom one, their bottom surfaces are formed with a slightly protruding foot like the foot 71 of crown 63' shown in FIG. 15. Each foot has a size and shape to fit and nest within the depression of the block beneath it, for stack stability. This also enables them to be easily stored and transported in stable stack formation. The top block 66' has a notch 75 while the crown 63 has a utility channel 70 through which an electrical cable may extend and pass through notch 75 into ambient ground from railroad signal and traffic control apparatuses mounted atop the crown. The pillar block and crown are formed with tapered holes 73 for ease in accepting the six guide rods 65 during assembly.

Figure 14:
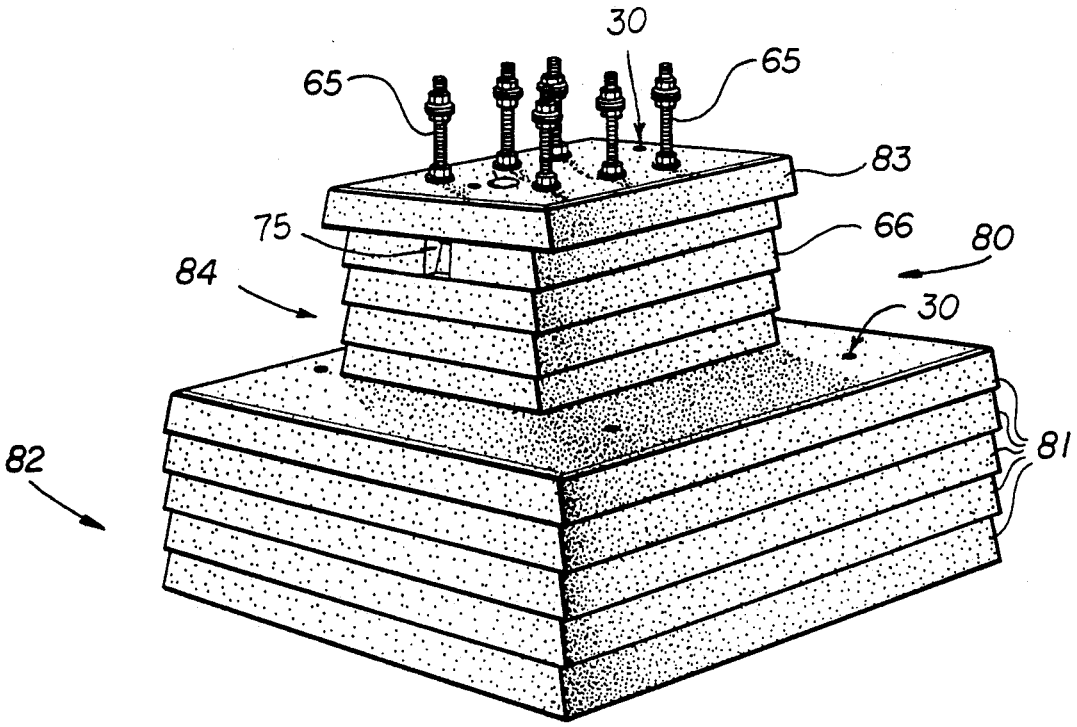
FIG. 14 is a perspective view of still another railroad signal foundation of the invention quite similar to that of FIG. 12.

The foundation 80 of FIG. 14 is the same as that of FIG. 12 except that all of the slabs 81 of the base 82 are of one piece construction. Also, the crown 83 here does not have the utility channel nor does the top block of the pillar 84 have a cable notch.

Figure 16:
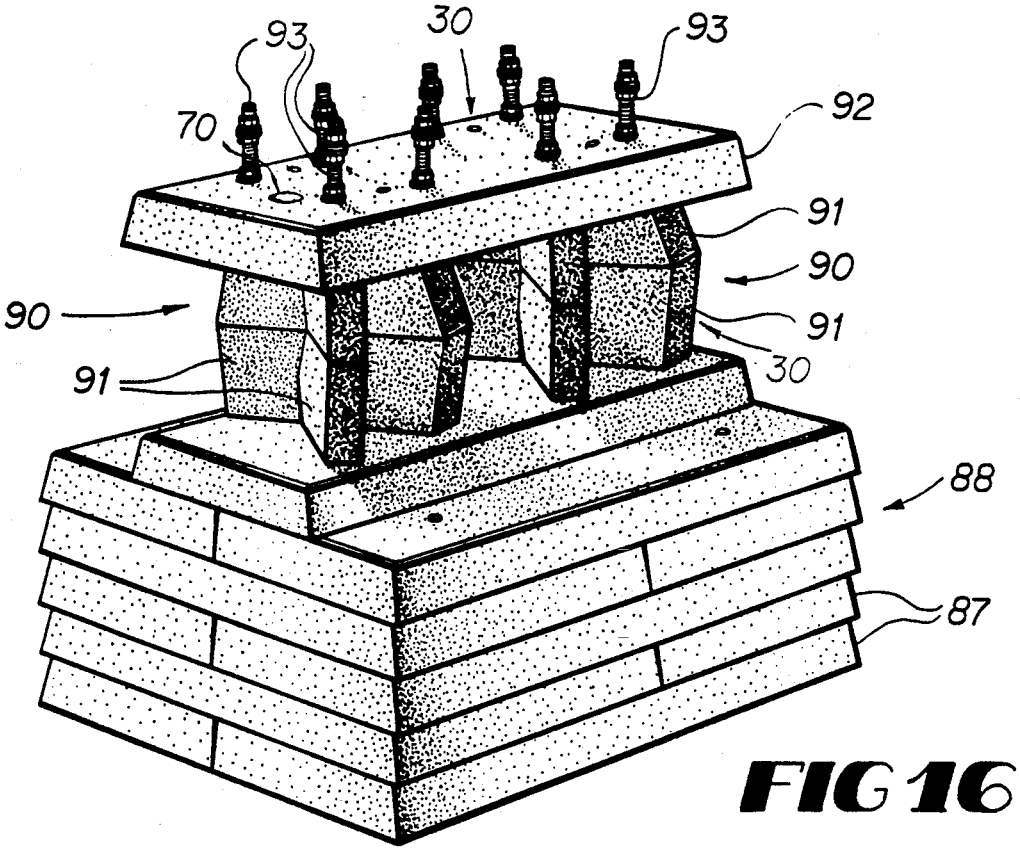
Figure 17:
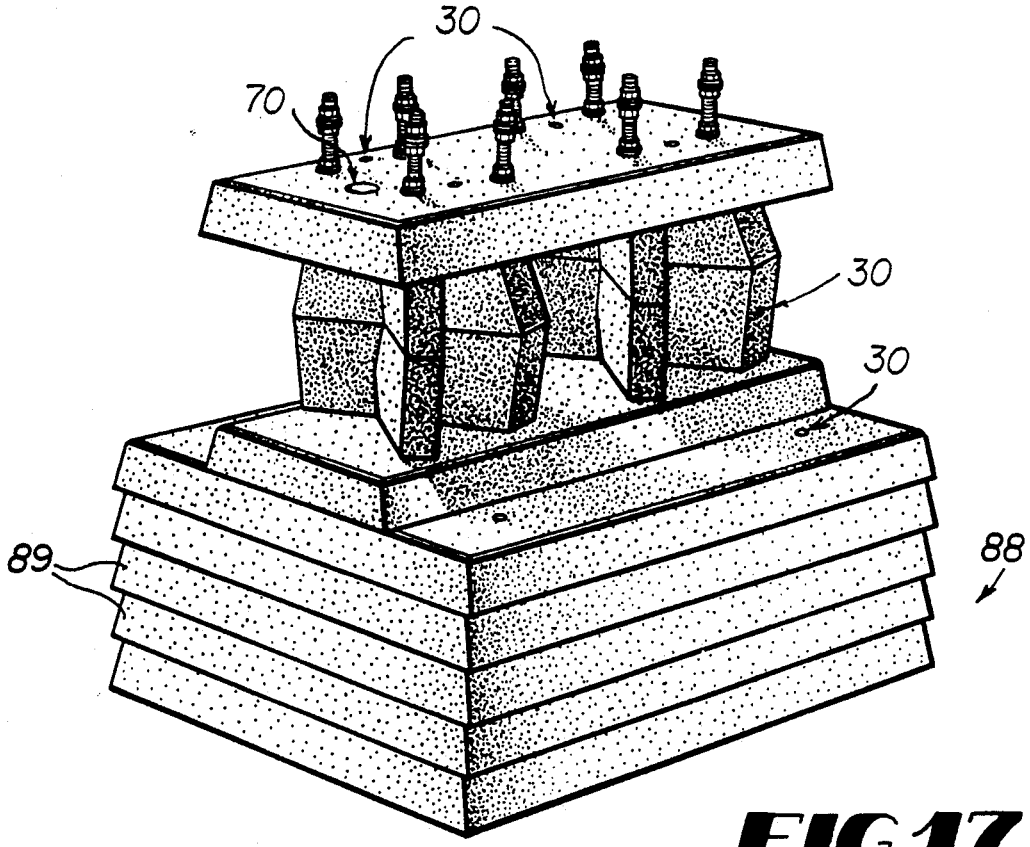
FIG. 17 shows it in a slightly modified form.

The foundations of FIGS. 16 and 17 differ mainly in that the slabs 87 of the base 88 of FIG. 16 are of two piece construction while the slabs 89 of the base 88 of the FIG. 17 design are one piece. These foundations have two pillars 90, each comprised of two tiers of interlocked spider blocks 91 which support a rectangular crown 92. All of the foundation components here are mounted to eight guide rods 93. A utility access channel 94 is provided in the crown 92.

Figure 18:
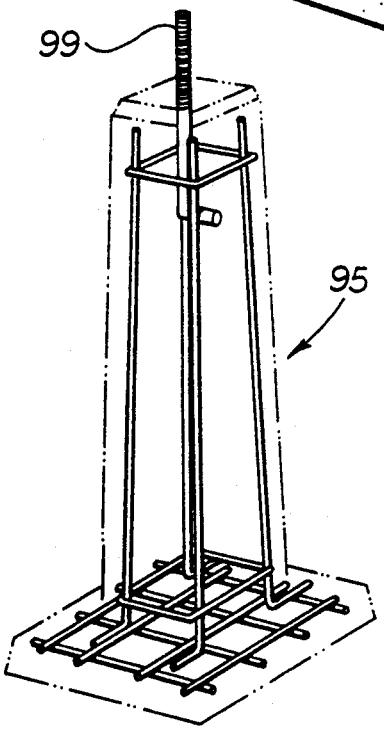
FIG. 18 is a perspective view of the framework of a pedestal.
Figure 19:
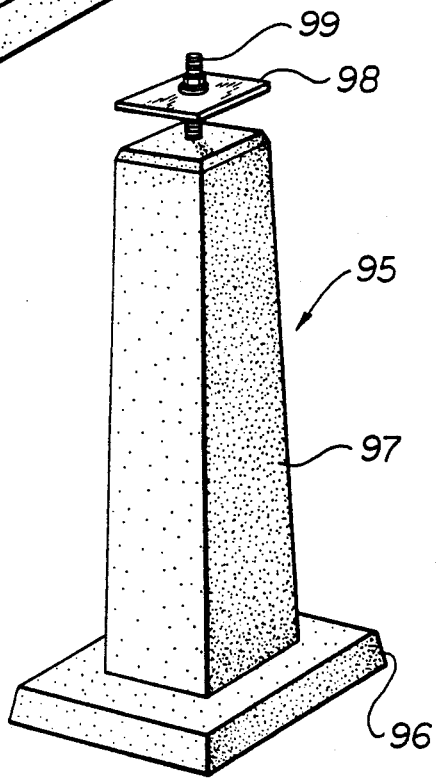
FIG. 19 is a perspective view of the complete pedestal that has the framework of FIG. 18.
Figure 2:
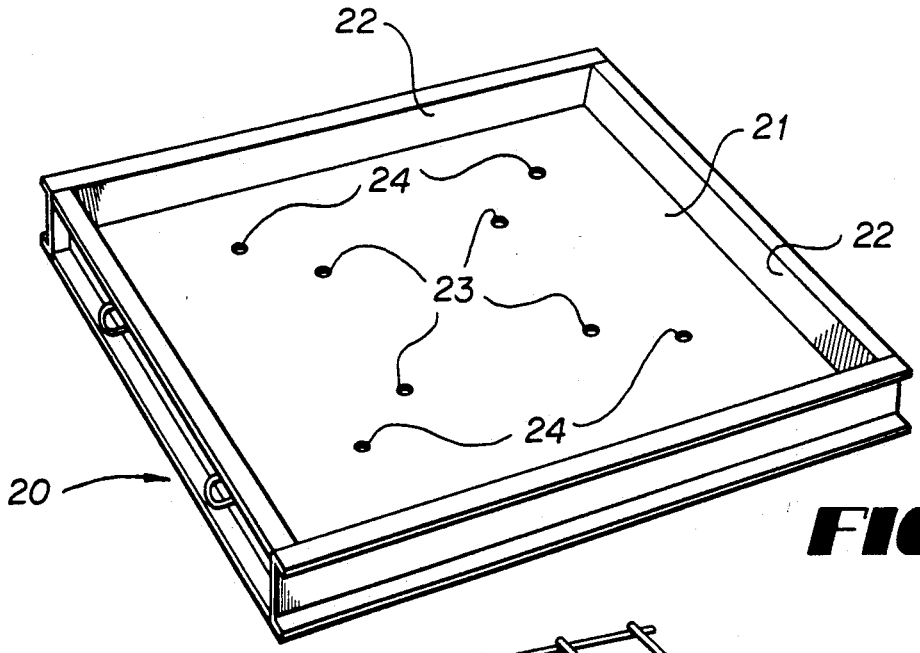
FIG. 2 is a perspective view of a mold used in manufacturing the base slabs of the foundation of FIG. 1.

FIGS. 18 and 19 merely show a relay house pier 95 that has a concrete base 96, a concrete pillar 97 and crown plate 98 all mounted on an upright guide rod 99. As shown in FIG. 18, the concrete members are steel reinforced.

The foundation of FIG. 1 has slabs 15 that measure 6 ½ feet square, herein referred to as its support area size, and ½ feet high except for the bottom slab 15' which is 7 inches high. Each weighs about 3,000 pounds. Each spider block here has a support area size of 40 inches long by 8 inches wide, and has a height of one foot. It weighs about 285 pounds. The uppermost spider block is only 8 inches high and weighs about 190 pounds. The crown 13 has an outside diameter of 36 inches to 42½ inches with a tapered hole inside diameter measuring 18 inches to 24 inches. It weighs about 1,200 pounds. The center of gravity of the foundation is about 4½ feet below the top surface of the ground which places it in the middle slab member of the foundation base 11.

The foundations 60 and 80 of FIGS. 12 and 14 have the same size and weight base slabs as that of foundation 10 of FIG. 1. The lowest pillar block here is 6 inches high and 48½ by 37½ by 6 inches and weighs about 924 pounds. The second and fourth ones from the base are 48½ by 37 ½ by 8¾ inches and weigh about 1,287 pounds. The third one from the base is 48½ by 37¾ by 6½ inches and weighs about 997 pounds. The crown is 52 by 42 by 8 inches and weighs about 1,640 pounds. The center of gravity of these foundations is about 43 inches below the top surface of the crown which places it near the bottom of the uppermost slab of the base.

Finally, the foundation of FIGS. 16 and 17 have 6½ by 6½ by ½ feet slabs weighing 3,300 pounds each and with the single slab directly supporting the spider blacks being 6½ by 3½ by ½ feet and weighing about 1,705 pounds. The spider blocks here are 12 inches high, 40 inches long and 8 inches wide and weigh 285 pounds. The crown 92 is 6½ feet long, 3½ feet wide and 8 inches high and weighs 2,250 pounds. The center of gravity of these foundations is located fairly centrally down in the base.

Typically, the foundation of FIG. 1 is used to support flashing lights, gate arm assemblies and single mast cantilevers. The foundations of FIGS. 12, 14, 16 and 17 support double mast cantilevers.

It thus is seen that a new railroad crossing signal and traffic control foundation is now provided that overcomes problems long associated with those of the prior art. It should be understood however that many modifications, additions and deletions may be made to the embodiments specifically described without departing from the spirit and scope of the invention as set forth in the following claims.

I claim:

1. A railroad crossing signal foundation comprising a base having a lower concrete base slab with a set of anchor plates embedded therein to which a set of upright guide rods is directly mounted and a plurality of upper concrete base slabs having selected support area sizes supported upon said lower base slab through which said guide rods extend; a pillar mounted upon said base comprised of a plurality of concrete pillar blocks through which said guide rods extend, said pillar blocks having support area sizes substantially less than said support area sizes of said base slabs such that said pillar may be erected by workers standing upon said base; and a crown mounted upon said pillar through which said guide rods extend, and wherein the center of gravity of said foundation is located in said base.

2. The railroad crossing signal foundation of claim 1 wherein said lower base slab has a grid of reinforcing rods embedded therein that overlays said anchor plates.

3. The railroad crossing signal foundation of claim 2 wherein said lower base slab has another grid of reinforcing rods embedded therein that underlays said anchor plates.

4. The railroad crossing signal foundation of claim 1 wherein said upper base slab are of substantial equal support area size.

5. The railroad crossing signal foundation of claim 1 wherein said pillar blocks are of substantially equal support area size.

6. The railroad crossing signal foundation of claim 1 wherein at least some of said pillar blocks have an upper surface formed with a recess and a lower surface formed with a protruding foot of a size and shape to reside with said recess.

7. A railroad crossing signal foundation comprising a base having a lower concrete base slab to which a set of upright guide rods is mounted and a plurality of upper concrete base slabs of two piece construction having selected support area sizes supported upon said lower base slab through which said guide rods extend; a pillar mounted upon said base comprised of a plurality of concrete pillar blocks through which said guide rods extend, said pillar blocks having support area sizes substantially less than said support area sizes of said base slabs such that said pillar may be erected by workers standing upon said base; and a crown mounted upon said pillar through which said guide rods extend, and wherein the center of gravity of said foundation is located in said base.

8. A method of constructing a railroad crossing signal foundation comprising the steps of digging a hole in the ground adjacent to the crossing with a generally flat and level hole floor of a selected size; erecting a concrete base in the hole of a size that occupies the hole sufficiently to preclude workers from entering the hole and standing beside the base during its construction by lowering concrete slabs in succession into the hole to form a stack of slabs with chains secured to eyebolts mounted to the slabs, and detaching the eyebolts from each slab after it is lowered and before another slab is lowered upon it; erecting a concrete pillar upon the base of a size that enables a worker it stand upon the base during erection of the pillar; and mounting a crown upon the pillar to which a railroad crossing signal may be mounted.

* * * * *